United States Patent [19]

Kamenske

[11] Patent Number: 4,787,113

[45] Date of Patent: Nov. 29, 1988

[54] HAND-MOUNTED SQUEEGEE

[76] Inventor: David R. Kamenske, Rt. 1, Box 250, Bellwood, Nebr. 68624

[21] Appl. No.: 148,277

[22] Filed: Mar. 25, 1988

[51] Int. Cl.[4] ..... A47L 25/00

[52] U.S. Cl. ..... 15/245; 15/227

[58] Field of Search ..... 15/227, 245, 236 R; D32/41

[56] References Cited

U.S. PATENT DOCUMENTS 4,342,128 8/1982 Doyle ..... 15/245

FOREIGN PATENT DOCUMENTS 1597837 9/1981 United Kingdom ..... 15/245

*Primary Examiner*—Edward L. Roberts

[57] ABSTRACT

A squeegee for mounting on the back of a operator's hand, comprising a base portion; a device for attaching the base portion to a operator's hand, such device preferably a strap, a upwardly projecting portion attached to said base at its lower end, the upwardly projecting portion being flexible and thin enough for good wiping qualities. The outwardly projecting portion being thick enough to avoid a tendency to ride over the top of water on a smooth surface to be squeegeed.

6 Claims, 1 Drawing Sheet

HAND-MOUNTED SQUEEGEE

BACKGROUND OF THE INVENTION

In the prior art many kinds of squeegees have been proposed for wiping water from eye glasses, goggles, and face-masks.

It is often during very dangerous activities that moisture prevents vision. It is common that snow and rain get on the glasses or goggles of skiers, on the face-masks of motor-cyclists, and on the gas-masks of the military.

Under dangerous conditions it is often important that a person have both hands occupied with the holding of a ski pole, hand-grip of a motor-cycle or the fire hose, axes or tools of a fireman.

In such conditions, it is important that an operator's hand be only momentarily distracted away from other work into wiping away moisture. It is important that this "wiping" be accomplished very quickly. Important, especially so, because in some conditions an extra "wiping" is needed only moments after a previous "wiping".

Because of these problems, it has been important that a "squeegee" be made available that is efficient.

In the prior art, a device has been marketed fitting the back of a person's hand, with the intentions that it be used to wipe away moisture. However, the edge engaging the surface to be wiped was excessively stiff and unable to conform to the curvature of the surfaces of spectacles, goggles, and face-masks.

It is therefore, an object of this invention to provide a hand-mountable squeegee, that is, by its dimensions, capable of conforming to curved surfaces ordinarily existent on such face coverings as described, so that good moisture removing action results from the conforming, yielding shape.

Another objective is to provide a method of connecting the squeegee to the hand of an operator, by a wide elastic band which will hold firmly without slipping and which is quick to put in use position, and which is inherently strong, though much of its attachment system is of one piece of material with the squeegee, itself.

DESCRIPTION OF THE PREFERRED EMBODIMENT

Figure 1:
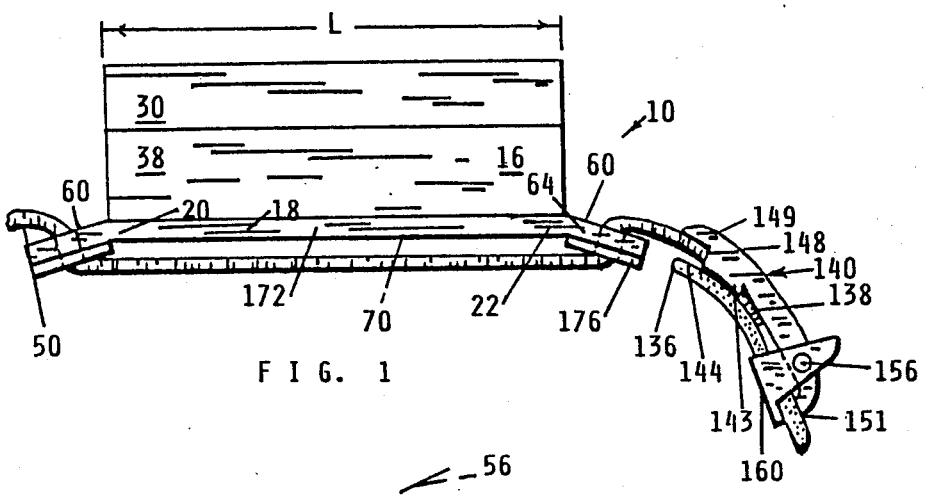
FIG. 1 is a frontal elevation of the main parts of the squeegee of this invention as they would appear when not mounted on an operator's wrist.

The hand mounted squeegee hereof is generally shown at 10 in FIG. 1 and has a main section 16 formed of one piece of flexible rubberlike material later described.

The main section 16 has a base 18 which is generally rectangular in top plan view having left and right ends 20 and 22 and front and rear sides 24 and 26. A triangular portion 38 of the main section 16 has its front and rear inclining sides 42 and 44 which almost converge at their upper ends.

An upwardly projecting protrusion or projection 30 of the main section 16 is attached to the base 18.

A hand-encircling device used is a strap 50.

Attaching ears 60 at each side of the base 18 each have a slot 64 for receiving the strap 50 upwardly therethrough.

The protrusion 30 is sufficiently flexible as to conform to the curvature of the forward side of a lens of a pair of sepctacles. The forward side of such shown in dotted lines diagrammatically at 56 in FIG. 2.

The base 18 has the lowermost portions of the outer edges of its forward side 24 and its rearward side 26 laying substantially in a first plane 70.

The protrusion 30 has a forward 72 and a rearward side 74, together defining a pair of sides; the protrusion 30 having an upper end 78 having a wiping edge 80 or 82 on at least one of its said pair of sides.

The wiping edges 80 and 82 each have at least one elongated portion extending from left to right. The protrusion 30 is elongated from left to right.

The distance between the forward and rearward sides 72 and 74 of the protrusion 30 at its upper end defines a first distance 130. Such first distance 130 is between 1/32nd and 3/32nds inch and preferably 1/16ths inch.

The forward and rearward sides of the protrusion 30 are spaced such that the average thickness of the protrusion from forward to rearward is such as would occur if the protrusion is approximately ½ inch in height and if its forward and rearward sides are each planar and are inclinedly disposed diverging from each other as their downward sides are approached, such diverging being at an angle of substantially 10 degrees.

The strap 50 has two ends 136 and 138. A clasp 140 is attached by nibs 143 thereof to one end portion 144 of the strap 50. The clasp 140 is capable of releasable adjustable attachment at various positions on the other end portion of said strap because its bar 148 with teeth at 149 and 151 pivots at pin 156 mounted on a fulcrum 160 and releases at teeth 151.

The grip positions of the clasp 140 vary in spacing with respect to each other by infinitessimal amounts. The strap 50 is formed of elastic material which has an amount of elasticity which will hold firmly when disposed closely against the operator's wrist but which will not cut off circulation at the operator's wrist to such an extent that the respective hand would become numb.

The nose clearance distance from the underside of said base 18 to the wiping edges 80 or 82 is at least 27/32nds and preferably 1 and 3/32nds of an inch so that the operator's nose does not interfere with wiping.

Figure 2:
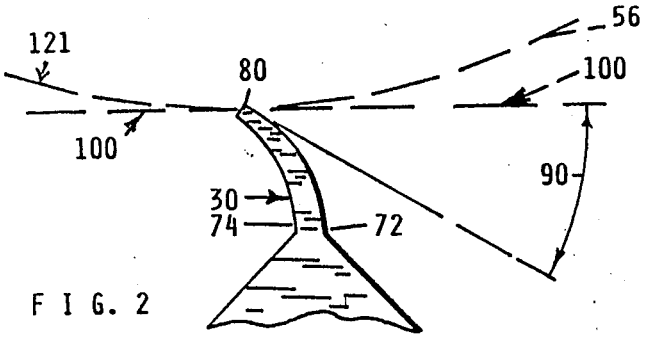
FIG. 2 is a diagramatic view of an end portion of the squeegee as bent during wiping of a curved surface shown in dotted lines.
Figure 3:
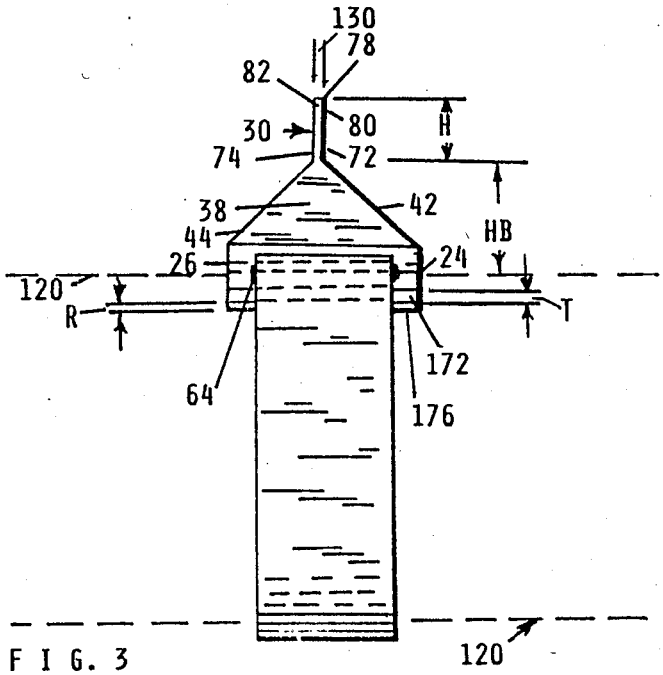
FIG. 3 is a side elevation of the squeegee shown as mounted on an operator's wrist, the latter being shown in dotted lines.

The attack angle 90 which the one side 72 of the protrusion 30 makes with respect to a second plane 100 parallel to the first plane 120 will be substantially 20 degrees to 40 degrees and preferably 30 degrees when the bending is caused by a pressing force from an operator's wrist which is at substantially the maximum which will not dislodge from an operator's face a pair of over-the-ear bow type of spectacles 121, mostly not shown except only the forward side of the lens 56 of such spectacles 121 is diagrammatically shown in FIG. 2. The spectacles 121 are to be understood as having a capability of gripping the operator's head with an average gripping resistance to the dislodging of the spectacles from their proper position on the operator's head by such a wiping force when such force is applied during a horizontal motion of the squeegee.

The base 70 has an upper main portion 122 which is vertically 0.1 inches thick throughout at T and it needs to be strengthened by perforated reinforcement sections 176 which are 0.05 inches thick at R, and are of one piece with the rest of the entire main section 16 and underlie the base 22 at its left and right projecting ears 60 to reinforce around the slots 64.

The length L from left to right of the wiping edges 80 and 82 is three inches.

The triangular portion 38 is of an important shape as the sides 42 and 44 must incline to avoid bumping an operator's nose.

The flexible material of which the main section 16 is injection molded is a thermoplastic named "KRYTON" which can be purchased through:

ACE METALS COMPANY

P.O. BOX 1887

KEARNEY INDUSTRIAL SITE:

KEARNEY, NEBR. 68847

The height H of the protrusion 30 is ½ inch. The height HB of the triangular section 38 is ½ inch.

I claim:

1. A squeegee for mounting on the back of an operator's hand comprising a base elongated from left to right and having left and right ends and front and rear sides, said base having an undersurface having a forward side and a rearward side, the lowermost portions of the outer edges of which lie substantially in a first plane, an upwardly projecting protrusion attached to said base and also elongated from left to right, a hand-encircling means for extending around an operator's hand, attaching means attaching said hand-encircling means to said base, said protrusion having a forward side and a rearward side together defining a pair of elongated sides extending along the elongation of said protrusion, said protrusion having an upper end having a wiping edge on at least one side of its said pair of sides, said wiping edge having at least one elongated portion extending from left to right, said pair of sides extending along the elongation of said protrusion and transversely to said first plane, there being for reference a second plane parallel to said first plane and extending through said wiping edge, said forward and rearward sides of said protrusion being spaced to provide a specific flexibility such that when pressure is placed on said protrusion so that it bends to that one of its pair of sides which is opposite from said one side on which said wiping edge is disposed then the attack angle which said one side of said protrusion makes with respect to a second plane parallel to said first plane will be substantially 20 degrees to 40 degrees when said bending is caused by a pressing force from an operator's wrist which is at substantially the maximum which will not dislodge from an operator's face a pair of over-the-ear bow type of spectacles on which is the lens being wiped, such spectacles having a capability of gripping the operator's head with an average gripping resistance to the dislodging of the spectacles by such a wiping force when such force is applied during a horizontal motion of the squeegee.

2. The squeegee of claim 1 herein said attack angle is substantially 30 degrees.

3. The squeegee of claim 1 wherein the distance between said forward and rearward sides of said protrusion at the upper end of said protrusion defining a first distance, said first distance being between 1/32nd and 3/32nds inch, said forward and rearward sides of said protrusion being spaced such that said average thickness of said protrusion from forward to rearward is such as would occur if said protrusion is approximately ½ inch in height and if its forward and rearward sides were inclinedly disposed diverging from each other as their downward sides are approached, such diverging being at an angle of substantially 10 degrees.

4. The squeegee of claim 1 wherein said attachment means comprises a strap having two ends, a clasp attached to one end portion of said strap, said clasp being capable of releasable adjustable attachment at various positions on the other end portion of said strap, said positions varying in spacing with respect to each other by infinite amounts, said strap being formed of elastic material which has an amount of elasticity which will hold firmly when disposed closely against the operator's wrist but which will not cut off circulation at the operator's wrist to an extent that the respective hand would become numb.

5. The squeegee of claim 1 wherein the nose clearance distance from the underside of said base to said wiping edge being at least 27/32nds of an inch so that the operator's nose does not interfere with wiping.

6. The squeegee of claim 5 wherein said clearance distance is substantially 1 and 3/32nds of an inch.

* * * * *